US005975056A

United States Patent [19]

Augustin et al.

[11] Patent Number: 5,975,056

[45] Date of Patent: Nov. 2, 1999

[54] PROCESS FOR REGULATING THE INJECTION QUANTITIES OF INJECTORS OF A FUEL-INJECTING INTERNAL-COMBUSTION ENGINE

[75] Inventors: Ulrich Augustin, Kernen; Volker Schwarz, Weinstadt, both of Germany

[73] Assignee: DaimlerChrysler AG, Germany

[21] Appl. No.: 09/005,829

[22] Filed: Jan. 12, 1998

[30] Foreign Application Priority Data

Jan. 11, 1997 [DE] Germany ..... 197 00 738

[51] Int. Cl.[6] ..... F02M 39/00

[52] U.S. Cl. ..... 123/478; 123/456; 123/300

[58] Field of Search ..... 123/456, 478, 123/300, 479, 480, 497, 139; 73/119 A; 70/103

[56] References Cited

U.S. PATENT DOCUMENTS

| | | | |
|---|---|---|---|
| 4,068,640 | 1/1978 | Watson et al. | 123/139 |
| 5,121,730 | 6/1992 | Ausman et al. | 123/467 |
| 5,201,294 | 4/1993 | Osuka | 123/458 |
| 5,542,395 | 8/1996 | Tuckey et al. | 123/497 |

FOREIGN PATENT DOCUMENTS

| | | |
|---|---|---|
| 3-54333 | of 1991 | Japan . |
| 8-158911 | of 1996 | Japan . |
| 2 227 386 | of 1994 | United Kingdom . |
| 2 287 101 | of 1994 | United Kingdom . |
| 2277386 | of 1994 | United Kingdom . |

*Primary Examiner*—Willis R. Wolfe
*Assistant Examiner*—Mahmoud M. Gimie
*Attorney, Agent, or Firm*—Evenson, McKeown, Edwards & Lenahan, P.L.L.C.

[57] ABSTRACT

In a process for regulating the injection quantities of injectors which are fluidically connected with a common pressure line in a common-rail injection system of an internal-combustion engine, a fuel pump provides fuel in the pressure line under a static nominal pressure. Control signals for opening and closing within individual injection periods for achieving respective identical injection quantities are supplied to the injectors by a regulator unit. In the case of different flow rates of the individual injectors respective identical injection quantities are achieved by the regulator unit by changing the respective injection period on the basis of a measuring signal. For this purpose, a pressure gauge inserted into the pressure line generates a measuring signal from a measurement of the static measuring pressure in the pressure line in each case after the closing of an injector. From the difference between the nominal pressure before the injection and the differential pressure after the injection, the regulator unit determines the fuel quantity taken from the pressure line during the injection. In case of a deviation from a known desired value, the regulator causes a corresponding change of the injection period of the diagnosed injector.

9 Claims, 2 Drawing Sheets

PROCESS FOR REGULATING THE INJECTION QUANTITIES OF INJECTORS OF A FUEL-INJECTING INTERNAL-COMBUSTION ENGINE

BACKGROUND AND SUMMARY OF THE INVENTION

This application claims the priority of German patent document 197 00 738.4, the disclosure of which is expressly incorporated by reference herein.

The invention relates to a process for regulating the quantity of fuel injected by fuel injectors in an internal-combustion engine.

The operating behavior of an internal-combustion engine depends significantly on the combustion conditions in the individual cylinders. Efficient operation requires identical optimal fuel/air mixture conditions in each cylinder. In fuel-injecting internal-combustion engines, it is therefore necessary (if possible) that the injectors inject the respective identical fuel quantity during each injection.

Injection systems for internal-combustion engines are known in which the injectors are fluidically connected with a common pressure line which carries fuel under a static pressure. The injectors can be opened up for injection at different points of time. A fuel pump redelivers the fuel quantities taken from the pressure line and generates a certain static nominal pressure which is applied to each pressure line and therefore to the respective injectors, at least before each injection. In such injection systems, called common-rail systems, the injection quantity of the injectors depends not only on the static pressure in the common pressure line and the injection time between the opening and the closing of the respective injector during the injection, but also depends to a large degree on the geometrical dimensions and the condition of the respective injectors. Although the injection period is the same, varying injection quantities of different injectors may be caused, for example, by tolerances of the injection nozzles or by a locally varying vibration behavior of the fuel in the environment of an injector. However, the main cause of varying injection quantities is the dirtying of the injectors by deposits as the service life of the internal-combustion engine advances, such that the fuel flow rate of a dirty injector is reduced.

In order to ensure identical injection quantities of all injectors, British Patent Document GB-2277386A suggests a process for detecting the condition of the injectors in the injection system during the operation of the internal-combustion engine. When an injection quantity is diagnosed which deviates from the desired value, the injection time of the injector is changed in the subsequent injections, so that the desired fuel quantity is injected in each case. The reduced injection quantity of a dirty injector is therefore compensated by a corresponding extension of the injection period. A regulator unit supplies to each injector an individual control signal for opening and closing with an injection period corresponding to the injection quantity. The pressure line is supplied with fuel by a fuel pump which generates a largely constant fuel pressure in the pressure line. Pressure losses in the pressure line caused by injections are immediately compensated by the fuel pump. In order to limit the fuel pressure to a defined nominal pressure during the delivery of the fuel, when the nominal pressure is exceeded, a pressure regulator opens up a return flow line to the fuel tank.

In order to generate measuring signals which can be supplied to the regulator unit and can be used as a basis for regulating the flow rates (and thus the injection quantities of the individual injectors), a pressure sensor is arranged in the pressure line. The pressure is regulated by changing the individual control signals of the injectors.

The pressure sensor detects reflection pressure waves which are caused by the operation of individual injectors during each injection and, from the time sequence of the reflection waves in the pressure line, generates a correlating electric signal which is supplied to a processor unit for analysis. Simultaneously, the processor unit receives a timer signal from the regulator unit in order to synchronize the detected reflection pressure waves with the operation of the injectors, and to assign each pressure wave signal to the responsible injector.

The processor unit's analysis of the time sequence of the electric signal of the pressure sensor yields the information concerning the qualitative time sequence of the reflection pressure waves in the pressure line caused by individual injectors. The time variations of the individual reflection pressure waves or of the pertaining electric pressure sensor signals are detected by the processor unit after the release by the injectors. For this purpose a plurality of successive measuring values are collected during respective analyzing periods. During a first analyzing period before the opening of an injector, a first series of multiple measuring values is taken, while in a second analyzing period (during the injection), another series of multiple measuring values is taken, from the electric signal of the pressure sensor. From the measuring values of both series, in each case the processor unit determines one average value and generates an output signal from the difference between the two average values. By means of this output signal, information is supplied to the regulator unit concerning the flow rate and the injection quantity of the diagnosed injector. If the dirtying of an injector is discovered, the regulator unit will change the control signals of the concerned injector, based on the output signal of the processor unit.

The known process requires high expenditures during the analysis of the pressure signal for generating a regulating quantity for the regulator unit, as well as a complicated electronic system. Particularly when the process is used for regulating the injection quantities of injectors of a common-rail injection system of an internal-combustion engine, it is difficult to control disturbing influences on the pressure sensor in the pressure line. For example, different response times of the pressure sensor during injections, for injectors at varying distances from the sensor, caused by the respective propagation rate of the reflection wave or by the disturbing reflection waves of the fuel pump or of the pressure regulator in the fuel line which, in an interfering manner, are superimposed on the reflection waves of the injectors to be measured and analyzed.

It is therefore an object of the present invention to provide a simple and reliable process and apparatus for regulating the injection quantities of injectors.

This and other objects and advantages are achieved by the regulating process according to the invention, in which after the closing of an injector, in each case the pressure gauge measures the static differential pressure in the pressure line and generates the measuring signal therefrom. From the measuring signal, the regulator unit determines the pressure difference between the nominal pressure in the pressure line before the opening of the injector and the differential pressure which exists because of the injection and the connected fuel removal from the pressure line. From the pressure difference between the absolute pressure values before and after the injection (nominal pressure and differential pressure), the precise injection quantity of the diagnosed injector can be determined by multiplying the pressure difference with the quotient from the known overall volume of the pressure line and the modulus of elasticity of the fuel. If the actual injection quantity deviates from a known desired value, the regulator unit corrects the individual control signals of the respective injector by changing the injection period by an amount corresponding to the deviation from the desired value. If, for example, an excessively reduced injection quantity, (due, perhaps to dirtying of the respective injector) is determined, during the subsequent triggering of this injector, the injection period will be extended by supplying correspondingly formed control signals.

The easy determination of the actual injection quantity is based on the compressibility characteristic of the fuel. The static pressure is formed by compressing, and is equivalent to a tendency of the fuel to expand. Since the compressibility of the fuel is determined by the (constant) modulus of elasticity, which defines the slope of the linear dependence of the volume change on the pressure change, the precise volume change in the pressure line can be determined based on the modulus of elasticity and a measurement of the pressure reduction by the expansion of the compressed fuel.

Advantageously, the fuel in the pressure line is subjected to a high static pressure of at least 100 bar. Because of the high static nominal pressure, the fuel in the pressure line is compressed such that large fuel quantities in comparison to the standard volume are stored in the pressure line. Preferably, the fuel is compressed in the pressure line by a pressure of approximately 1,500 bar, whereby short injection periods can be achieved with an exact measurement of the injection quantity, utilizing the compressibility characteristic and the expansion characteristic of the fuel.

In operating intervals between completed individual injections, the fuel pump delivers fuel into the pressure line. Each such operating interval is concluded when the nominal pressure is reached, so that the fuel quantity which was removed from the pressure line during the preceding injection is restored. (The nominal pressure in the pressure line is reached in each case before the start of the next injection and the opening-up of the corresponding injector.) If the differential pressure in the pressure line formed by the injection is measured by a pressure gauge, after the closing of the injector and before the fuel pump is started, a precise measuring signal can be generated for determining the fuel quantity actually removed from the pressure line due to the injection, and can be supplied to the regulator unit. During the time periods between the operating intervals and the injections, the respective static pressure in the pressure line will be constant. Thus, the detection of the nominal pressure before an injection and the differential pressure after the injection in corresponding time periods outside the operating interval of the fuel pump, permits a precise determination of the pressure difference which occurs during an injection, and thus of the actual injection quantity.

Advantageously, the operating intervals of the fuel pump are determined by the regulator unit, and start only after the presence of a measuring signal following measurement of the differential pressure after a fuel injection. The operating intervals of the fuel pump, and thus the further pressure rise in the pressure line because of the fuel delivery, will in each case be terminated by the regulator unit when the pressure gauge detects the normal pressure has been attained in the pressure line.

Despite short injection periods, a precise detection of the injection quantity is possible during the diagnosis of the injectors since the course of the pressure which is difficult to analyze at high pressures, during an injection, is unimportant for regulating the injection quantities. The required measuring signal is generated in a simple manner and with the highest precision from the difference between the nominal pressure in the pressure line before an injection and the differential pressure it after an injection. In this case, for measuring the nominal pressure or the differential pressure, respective arbitrary points in time are available to the pressure gauge in the time periods between the operating intervals of the fuel pump and the injections. If the pressure measuring signals are generated simultaneously with the respective operation of an injector (opening, closing), an operation is possible with rapidly successive injections, with the respective regulating of the injection quantity.

Other objects, advantages and novel features of the present invention will become apparent from the following detailed description of the invention when considered in conjunction with the accompanying drawings.

DETAILED DESCRIPTION OF THE DRAWINGS

Figure 1:
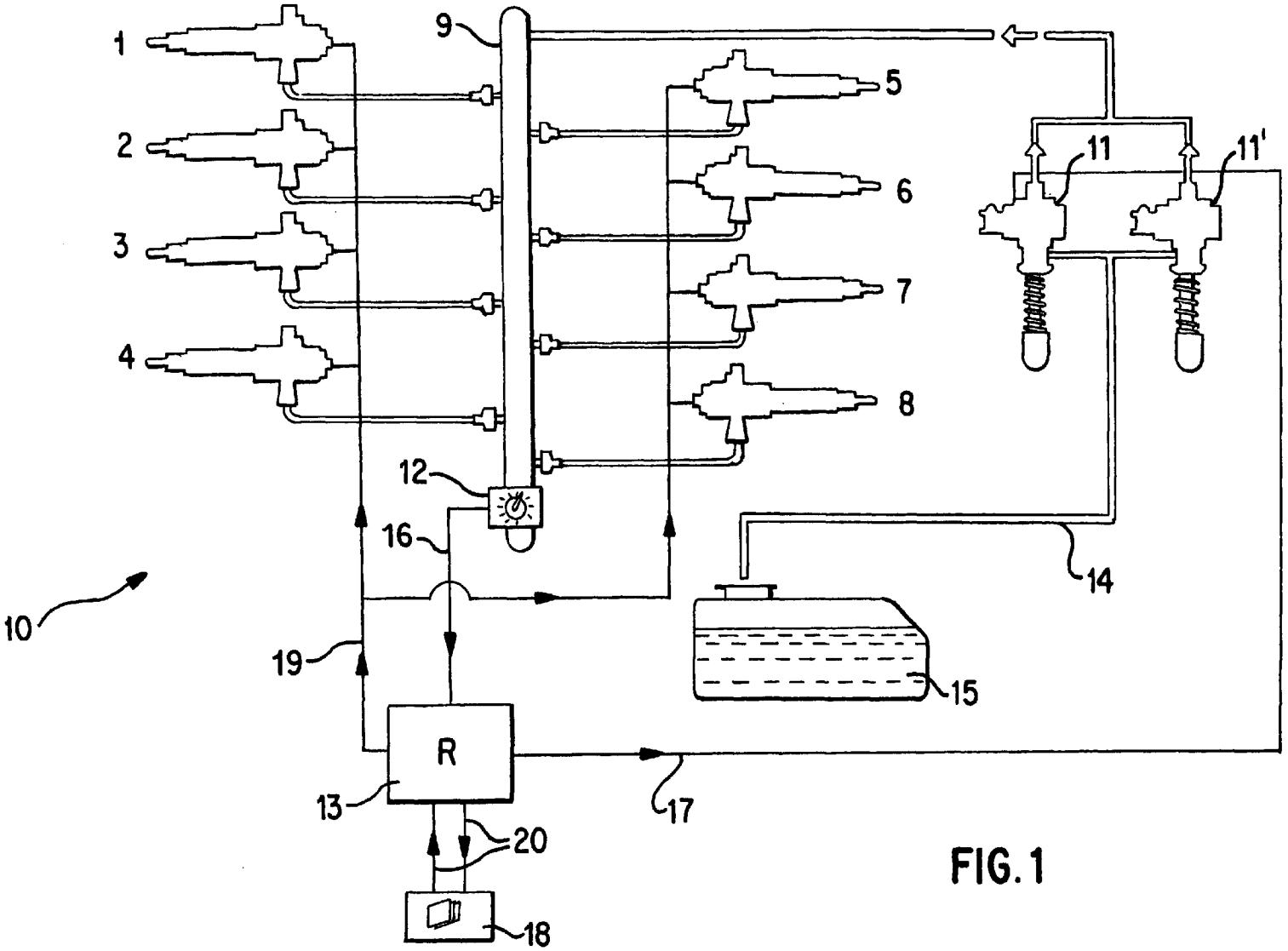
FIG. 1 is a schematic representation of a common-rail injection system with injection quantities of the injectors which can be regulated.

FIG. 1 illustrates a common-rail injection system 10 of an internal-combustion engine with 8 cylinders, into which injectors 1–8 respectively inject fuel for forming the mixture. The injectors 1–8 are fluidically connected with a common, fuel-carrying pressure line 9. Fuel removed from a fuel tank 15 by two fuel pumps 11, 11' by way of a fuel line 14 is delivered into the pressure line 9 and, under a static nominal pressure, is available there for the injection. The injectors 1–8 are actuated at different points in time according to the time-staggered operating cycles of the respectively assigned cylinders. For this purpose, an individual control signal 19 is supplied to each injector 1–8 for the opening and closing. The fuel quantity introduced into the cylinders during an injection is a function of the injection period and of the static nominal pressure which exists in the pressure line 9 in each case at the start of an injection during the opening-up of an injector. Between the respective injection of individual injectors 1–8 during a completed operating interval, the fuel pumps 11, 11' deliver fuel into the pressure line 9 and generate a defined static nominal pressure.

A prerequisite for optimal operation of the internal-combustion engine in all operating points is that identical mixture forming conditions exist in all cylinders, due to identical injection quantities of the injectors 1–8. In order to achieve respective identical injection quantities despite possible different flow-rate characteristics of the individual injectors 1–8, individual control signals 19 are supplied to the injectors 1–8 by a regulator unit 13, with different injection periods which take into account the condition of the respective injector 1–8. The control values 20 for generating the individual control signals 19 for the injectors 1–8 are filed in a characteristic diagram memory 18 for access by the regulator unit 13.

With increasing service life of the internal-combustion engine, deposits may form on the injectors 1–8, which differently influence the flow rate characteristics of the injectors. Identical mixture forming conditions in the individual cylinders are ensured by regulating the injection quantities with an individual variation of the injection period corresponding to the condition of the respective injector. For this purpose, a measuring signal 16 of a pressure gauge 12 arranged in the pressure line 9 is supplied to the regulator unit as the regulating quantity. After each fuel injection, the static pressure falls in the pressure line 9, and the regulator unit 13 starts the operation of the fuel pumps 11, 11' by supplying a delivery signal 17. After the feeding of a corresponding fuel quantity, if the pressure gauge 12 of the regulator unit 13 indicates that the nominal pressure in the pressure line 9 has been reached, the regulator unit 13 terminates the operating cycle of the fuel pumps 11, 11' before initiating the respective subsequent injection. After each fuel injection (after closing of the injector), the pressure gauge 12 measures the static pressure in the pressure line 9 and generates the measuring signal 16 therefrom. From the measuring signal, the regulator unit 13 determines the pressure difference between the nominal pressure before opening-up of the injector and the measured differential pressure after the closing of the injector. This pressure difference directly characterizes the injection quantity removed from the pressure line 9 during the fuel injection. Based on the known total volume V of the pressure line 9, the modulus of elasticity E of the fuel and the measured pressure difference AP, the volume change ΔV in the pressure line 9 and thus the removed fuel quantity can be calculated in a simple and very precise manner by means of the following quantity equation:

$$\Delta V=(V:E)\times\Delta P.$$

If the measuring signal 16 deviates from a desired value determined from control values 20 stored in the characteristic diagram memory 18 (that is, the determined actual injection quantity of the diagnosed injector deviates from the desired injection quantity), the regulator unit 13 corrects the injection quantity by varying the injection period corresponding to the deviation from the desired value. The corrected control values with the optimized injection period are stored by the regulator unit 13 in the characteristic diagram memory 18 in order to supply corrected individual control signals 19 for subsequent regulation of the injection quantity to the injectors 1–8.

During the diagnosis of an injector for detecting the actual injection quantity, the nominal pressure is measured before the injection, and the differential pressure is measured after the injection, in each case outside the operating interval of the fuel pumps 11, 11'. Thus, only the pressure difference in the pressure line 9 due to the opening-up of the injector is detected for determining the actual injection quantity.

After the closing of an injector at the end of an injection, the static pressure in the pressure line remains constant at the level of the differential pressure due to the injection, until the start of the operation of the fuel pumps 11, 11' raises it once again to the nominal pressure level. Thus, a time period is available between the end of the injection and the start of the operating interval of the fuel pumps 11, 11' in which, at an arbitrary point in time, the differential pressure can be measured by means of the pressure gauge 12 for regulating the injection quantity. In order to avoid a disturbing influence of the fuel pumps 11, 11' on the measuring result, an operating interval of the fuel pumps 11, 11' is initiated by the regulator unit 13 in each case only after receiving the measuring signal 16 from the pressure gauge 12 by supplying a delivery signal 17.

Figure 2:
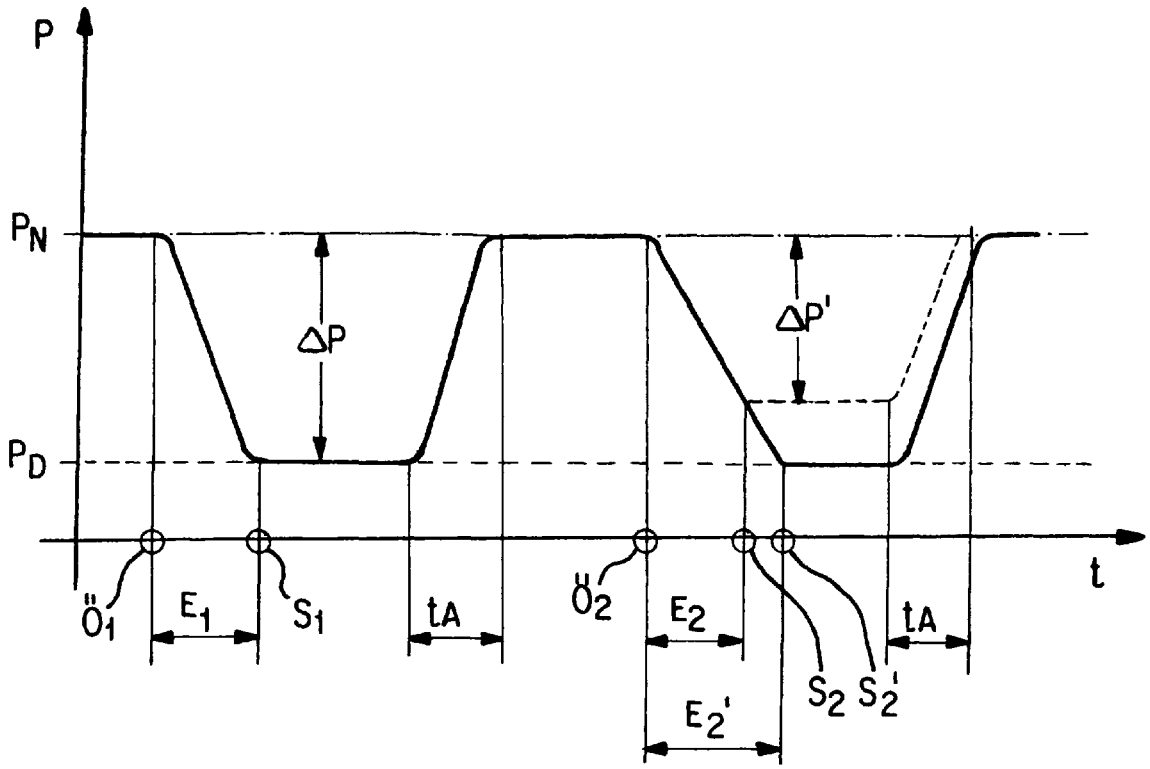
FIG. 2 shows the course of the static pressure in the pressure line as a function of time.

A typical course of the static pressure in the pressure line 9 over time is graphically illustrated in FIG. 2. A falling pressure course indicates a fuel removal from the pressure line during an injection, and a pressure rise (an increase of the pressure curve) indicates a fuel feeding during the operating intervals $t_A$ of the fuel pumps. The fuel pumps generate a nominal pressure $P_N$ which remains constant after the conclusion of the operating interval $t_A$ to the start of an injection. After the opening of an injector at the point in time $\ddot{O}_1$, the static pressure of the fuel in the pressure line falls as the result of the fuel removal during the injection. After a certain injection period $E_1$, the injector is closed and the static pressure drop is stopped. The pressure then remains constant as of the point in time $S_1$ of the closing. The static pressure after the point in time $S_1$ is measured, and, from the pressure difference ΔP between this static pressure and the nominal pressure $P_N$ before the injection, the injection quantity taken from the pressure line during the injection period $E_1$ can be precisely determined.

Ideally, the measured differential pressure corresponds to a known desired value $P_D$, in which case the pressure difference ΔP between the nominal pressure $P_N$ and the differential pressure $P_D$ indicates the removal of the desired injection quantity from the pressure line. However, if an injector is dirty, the fuel flow rate is reduced and a smaller fuel quantity is injected while the injection period is the same. If an injector is diagnosed as being dirty, in that the measured pressure difference ΔP' between the nominal pressure $P_N$ and the measured differential pressure is smaller than the desired value ΔP, the injection period of this injector is extended such that the desired fuel quantity is injected during the corrected injection period.

As an example, FIG. 2 shows the pressure course in the pressure line during injections first of an ideal (new) injector with the reference number 1 and then of a dirty injector having the reference number 2. If the injection period $E_2$ between the opening of the injector at the point in time $\ddot{O}_2$ and its closing at the point in time $S_2$ corresponds to the injection period $E_1$ of a properly operating injector, after the injection, the measured pressure difference ΔP' will be smaller than the desired value ΔP. If the regulator unit (FIG. 1) receives a measuring signal with the information of an insufficient pressure difference ΔP', the injection quantity is regulated by extending the injection period $E_2'$. During subsequent injections, the dirty injector in question will close at a later closing point in time $S_2'$. During the extended injection period $E_2'$, the desired fuel quantity will then be injected by the injector until a further condition change of the injector requires another change of the injection period and thus another regulating intervention in the respective injection quantity.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Process for regulating a quantity of fuel injected by injectors in a fuel injection system for an engine, wherein the injectors are fluidically connected with a common pressure line in which fuel under a nominal static pressure can be provided by a fuel pump, control signals for opening and closing the injectors within an individual injection period corresponding to the injection quantity being in each case feedable to the injectors, which control signals can be generated by a regulator unit and, on the basis of a measuring signal of a pressure gauge inserted in the pressure line, are individually variable, said process comprising:

using the pressure gauge to generate the measuring signal from a measurement of static differential pressure in the pressure line after each closing of an injector;

using the regulator unit to determine from the measuring signal a pressure difference between the static differential pressure and a static nominal pressure, due to the opening-up of the injectors;

using the regulator to determine from the pressure difference an injection quantity obtained from the pressure line; and in case of a deviation of a determined injection quantity of particular injectors from a known desired value, said regulator correcting the control signals for the particular injectors by changing an injection period thereof by an amount corresponding to the deviation from the known desired value.

2. Process according to claim 1 further comprising:

using the fuel pump to deliver fuel into the pressure line during operating intervals following completed injections of fuel;

using the pressure gauge to measure static nominal pressure before an injector opens, and the static differential pressure after the injector closes, outside the operating interval of the fuel pump, respectively; and using the pressure gauge to generate the measuring signal from the static nominal pressure before the injector opens and the static differential pressure after the injector closes.

3. Process according to claim 2, further comprising:

using the regulator unit to determine the operating intervals of the fuel pump.

4. Process according to claim 3, further comprising:

using the regulator unit to terminate the operating intervals of the fuel pump in each case when static nominal pressure exists in the pressure line.

5. Process according to claim 4, further comprising:

using the pressure gauge to generate the measuring signal from a measurement of the static differential pressure after an injection of fuel.

6. Process according to claim 1, further comprising:

simultaneously measuring the pressure for generating measuring signals and operating a respective injector.

7. Process according to claim 5, further comprising:

simultaneously measuring the pressure for generating measuring signals and operating a respective injector.

8. Process according to claim 1, further comprising:

subjecting fuel in the pressure line to a static pressure of at least 100 bar.

9. Process according to claim 8, further comprising:

subjecting the fuel in the pressure line to a static pressure of approximately 1,500 bar.

* * * * *